US008440601B2

(12) United States Patent
Seebeck et al.

(10) Patent No.: US 8,440,601 B2
(45) **Date of Patent: *May 14, 2013**

(54) DETERGENT FORMULATIONS FOR MACHINE DISHWASHING COMPRISING HYDROPHILICALLY MODIFIED POLYCARBOXYLATES

(75) Inventors: Tanja Seebeck, Bensheim (DE); Juergen Tropsch, Roemerberg (DE); Lars Kissau, Wachenheim (DE)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/325,446

(22) Filed: Dec. 14, 2011

(65) Prior Publication Data

US 2012/0122748 A1 May 17, 2012

Related U.S. Application Data

(62) Division of application No. 12/063,036, filed on Feb. 6, 2008, now Pat. No. 8,193,139.

(30) Foreign Application Priority Data

Aug. 31, 2005 (DE) ..... 10 2005 041 347

(51) Int. Cl.
*C11D 3/37* (2006.01)

(52) U.S. Cl.
USPC ..... 510/220; 510/229; 510/233; 510/434; 510/475

(58) Field of Classification Search ..... 510/220, 510/229, 233, 434, 475
See application file for complete search history.

(56) References Cited

U.S. PATENT DOCUMENTS

| | | | | |
|---|---|---|---|---|
| 5,786,313 | A * | 7/1998 | Schneider et al. | 510/219 |
| 5,981,798 | A * | 11/1999 | Schonherr et al. | 562/593 |
| 5,994,290 | A * | 11/1999 | Potthoff-Karl et al. | 510/531 |
| 5,998,346 | A * | 12/1999 | Welch et al. | 510/230 |
| 6,060,443 | A | 5/2000 | Cripe et al. | |
| 7,530,360 | B2 * | 5/2009 | Guzmann et al. | 134/25.2 |
| 2002/0198128 | A1 | 12/2002 | Perkins | |
| 2003/0158078 | A1 | 8/2003 | Chang | |
| 2003/0171246 | A1 | 9/2003 | Boeckh et al. | |
| 2004/0009889 | A1 * | 1/2004 | Tropsch et al. | 510/477 |
| 2004/0116319 | A1 | 6/2004 | Nitsch et al. | |
| 2005/0113271 | A1 | 5/2005 | Pegelow et al. | |
| 2005/0239680 | A1 | 10/2005 | Buchmeier et al. | |
| 2005/0245427 | A1 * | 11/2005 | Baum et al. | 510/475 |
| 2007/0042928 | A1 | 2/2007 | Appleby et al. | |
| 2007/0082831 | A1 * | 4/2007 | Guzmann et al. | 510/220 |
| 2007/0219110 | A1 * | 9/2007 | Becker et al. | 510/392 |
| 2008/0188391 | A1 | 8/2008 | Seebeck et al. | |

FOREIGN PATENT DOCUMENTS

| | | |
|---|---|---|
| CA | 2620240 | 3/2007 |
| DE | 102 25 594 | 6/2002 |
| DE | 102 33 834 | 2/2004 |
| EP | 1998 45456 A2 | 6/1998 |
| EP | 0 851 021 | 7/1998 |
| EP | 1754778 | 2/2007 |
| WO | 97 19159 | 5/1997 |
| WO | 2005 042684 | 5/2005 |
| WO | 2005042684 | 5/2005 |
| WO | 2007025944 | 3/2007 |
| WO | 2007025955 | 3/2007 |

* cited by examiner

*Primary Examiner* — Mark Eashoo
*Assistant Examiner* — M. Reza Asdjodi
(74) *Attorney, Agent, or Firm* — Oblon, Spivak, McClelland, Maier & Neustadt, L.L.P.

(57) ABSTRACT

A mixed powder or mixed granule for use in detergent formulations for machine dishwashing contains the following components: a) from 10 to 95% by weight of a copolymer of a1) from 50 to 93 mol % of acrylic acid and/or of a water-soluble salt of acrylic acid, a2) from 5 to 30 mol % of methacrylic acid and/or of a water-soluble salt of methacrylic acid, and a3) from 2 to 20 mol % of at least one nonionic monomer, wherein monomers a1) to a3) are copolymerized in a random or block manner, b) from 5 to 80% by weight of a complexing agent selected from the group consisting of a glycine-N,N-diacetic acid derivative and glutamic acid N,N-diacetic acid and salts thereof, c) from 0 to 20% by weight of a polyethylene glycol, of a nonionic surfactant or of a mixture thereof.

11 Claims, No Drawings

DETERGENT FORMULATIONS FOR MACHINE DISHWASHING COMPRISING HYDROPHILICALLY MODIFIED POLYCARBOXYLATES

This application is a division of U.S. application Ser. No. 12/063,036 filed Feb. 6, 2008 which is U.S. Pat. No. 8,193,139 B2 presently.

The invention relates to detergent formulations for machine dishwashing.

When dishware is cleaned in a machine dishwasher, the dishware, during the cleaning cycle, is freed from soil which is composed of a wide variety of food residues which also comprise fatty and oily constituents. The removed soil particles and components are circulated by pumping in the rinse water of the machine in the course of further cleaning. It has to be ensured that the removed soil particles are dispersed and emulsified effectively, so that they do not settle again on the ware.

Many formulations present on the market are phosphate-based. The phosphate used is ideal for the application, since it combines many useful properties which are required in machine dishwashing. One is that phosphate is capable of dispersing water hardness (i.e. insoluble salts of ions such as calcium and magnesium ions which cause water hardness). In fact, this task is also achieved by the ion exchanger of the machines. A large proportion of the products for machine dishwashing is, though, supplied nowadays in the form of what are known as 3-in-1 formulations in which the function of the ion exchanger is no longer needed. In this case, the phosphate, usually combined with phosphonates, takes over the softening of the water. In addition, the phosphate disperses the soil removed and thus prevents resettling of the soil on the ware.

In the case of cleaning compositions, many countries have made the transition for ecological reasons to fully phosphate-free systems. For the products for machine dishwashing too, there is discussion as to whether reversion to phosphate-free products is viable. However, the phosphate-free products which were still on the market in the mid-1990s no longer satisfy the current demands on the wash result. Nowadays, the consumer expects faultless, streak-, film- and drip-free dishes, preferably without the use of additional rinse aid or regenerating salt for the ion exchanger.

It is an object of the invention to provide phosphate-free detergent formulations for machine dishwashing. It is a particular object of the invention to provide such formulations which give rise to streak-, film- and drip-free dishes without use of additional rinse aid.

DE 102 25 594 A1 describes the use of copolymers comprising alkylene oxide units in laundry detergents and cleaning compositions, and also laundry detergents and cleaning compositions comprising these copolymers. However, no combinations of these polymers with complexing agents are described.

DE 102 33 834 A1 describes machine dishwasher detergents comprising from 1 to 25% by weight of a copolymer comprising alykaline oxide units. Also described are dishwasher detergents which, in addition to the polymers mentioned, may also contain complexing agents, preference being given to the use of EDTA. There is no mention of glycine-N,N-diacetic acid derivatives and glutamic acid N,N-diacetic acid and salts thereof.

It has now been found that the replacement of phosphate can be achieved by the use of certain hydrophilically modified polycarboxylates in combination with certain complexing agents.

In this case, the complexing agents assume the task of complexing the ions which cause water hardness (calcium and magnesium ions) which are present in the rinse water or in the food residues. Polycarboxylates likewise have calcium binding capacity and are additionally also still capable of dispersing sparingly soluble salts which form from water hardness and the soil present in the wash liquor. It is surprising that MGDA and GLDA in combination with the hydrophilically modified polycarboxylates have better scale-inhibiting action than EDTA even though their complex formation constant for Ca ions is smaller than that of EDTA.

The object is achieved by phosphate-free detergent formulations for machine dishwashing, comprising, as components:

a) from 1 to 20% by weight of copolymers of
   - a1) from 50 to 93.5 mol % of acrylic acid and/or of a water-soluble salt of acrylic acid,
   - a2) from 5 to 30 mol % of methacrylic acid and/or of a water-soluble salt of methacrylic acid,
   - and
   - a3) from 2 to 20 mol % of at least one nonionic monomer of the formula (I)

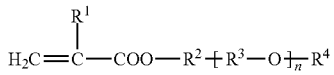

(I)

in which the variables are each defined as follows:

$R^1$ is hydrogen or methyl, $R^2$ is a chemical bond or unbranched or branched $C_1$-$C_6$-alkylene, $R^3$ are identical or different, unbranched or branched $C_2$-$C_4$-alkylene radicals, $R^4$ is unbranched or branched $C_1$-$C_6$-alkyl, n is form 3 to 50, where the monomers a1) to a3) are copolymerized in a random or block-like manner, b) from 1 to 50% by weight, preferably from 5 to 40% by weight, of complexing agents selected from the group consisting of glycine-N,N-diacetic acid derivatives and glutamic acid N,N-diacetic acid and their salts, c) from 1 to 15% by weight, preferably from 1 to 10% by weight, of low-foaming nonionic surfactants, d) from 0 to 30% by weight, preferably from 0 to 20% by weight, of bleaches and, if appropriate, bleach activators, e) from 0 to 60% by weight, preferably from 0 to 40% by weight, of further builders, f) from 0 to 8% by weight, preferably from 0 to 5% by weight, of enzymes, g) from 0 to 50% by weight, preferably from 0.1 to 50% by weight, of one or more further additives such as anionic or zwitterionic surfactants, bleach catalysts, alkali carriers, corrosion inhibitors, defoamers, dyes, fragrances, fillers, organic solvents and water, the sum of components a) to g) adding up to 100% by weight.

The formulation may be processed as a tablet, powder, gel, capsule, extrudate or solution. They may either be formulations for household applications or for industrial applications.

The object is also achieved by the use of a combination of copolymers a) and complexing agents b) as builder systems in detergent formulations for machine dishwashing. The builder system assumes the task of complexing the ions which cause water hardness (calcium and magnesium ions), which are present in the rinse water or in the food residues.

The object is also achieved by the use of a combination of copolymers a) and complexing agents b) as a scale-inhibiting additive in detergent formulations for machine dishwashing.

The copolymers a) comprising alkylene oxide units comprise, as copolymerized components a1) and a2), acrylic acid or methacrylate acid and/or water-soluble salts of these acids, especially the alkali metal salts such as potassium salts and in particular sodium salts, and ammonium salts.

The proportion of acrylic acid a1) in the copolymers to be used in accordance with the invention is from 50 to 93 mol %, preferably from 65 to 85 mol % and more prererably from 65 to 75 mol %.

Methacrylic acid a2) is present in the copolymers to be used in accordance with the invention to an extent of from 5 to 30 mol %, preferably to an extent of from 10 to 25 mol % and in particular to an extent of from 15 to 25 mol %.

As component a3), the copolymers comprise nonionic monomers of the formula (I)

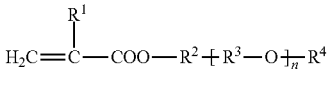

(I)

in which the variables are each defined as follows:

$R^1$ is hydrogen or preferably methyl, $R^2$ is unbranched or branched $C_1$-$C_6$-alkylene or preferably a chemical bond, $R^3$ are identical or different, unbranched or branched $C_2$-$C_4$-alkylene radicals, in particlar $C_2$-$C_3$-alkylene radicals, especially ethylene, $R^4$ is unbranched or branched $C_1$-$C_6$-alkyl, preferably $C_1$-$C_2$-alkyl, n is from 3 to 50, preferably from 5 to 40, more preferably from 10 to 30.

Particularly suitable examples of the monomers (I) include: methoxypolyethylene glycol(meth)acrylate, methoxypolypropylene glycol(meth)acrylate, methoxypolybutylene glycol(meth)acrylate, methoxypoly(propylene oxide-co-ethylene oxide) (meth)acrylate, ethoxypolyethylene glycol(meth)acrylate, ethoxypolypropylene glycol(meth) acrylate, ethoxypolybutylene glycol(meth)acrylate and ethoxypoly(propylene oxide-co-ethylene oxide) (meth)acrylate, preference being given to methoxypolyethylene glycol (meth)acrylate and methoxypolypropylene glycol(meth) acrylate and particular preference to methoxypolyethylene glycol methacrylate.

The polyalkylene glycols comprise from 3 to 50, especially from 5 to 40 and in particular from 10 to 30 alkylene oxide units.

The proportion of the nonionic monomers a3) in the copolymers to be used in accordance with the invention is from 2 to 20 mol %, preferably from 5 to 15 mol % and in particular from 5 to 10 mol %.

The copolymers to be used in accordance with the invention generally have a mean molecular weight $M_w$ of from 3 000 to 50 000, preferably from 10 000 to 30 000 and more preferably from 15 000 to 25 000.

The K value of the copolymers is typically from 15 to 40, especially from 20 to 35, in particular from 27 to 30 (measured in 1% by weight aqueous solution at 25° C., according to H. Fikentscher, Cellulose-Chemie, vol. 13, p. 58-64 and 71-74 (1932)).

The copolymers to be used in accordance with the invention may be prepared by free-radical polymerization of the monomers. It is possible to work by all known free-radical polymerization processes. In addition to polymerization in bulk, mention should be made in particular of the processes of solution polymerization and of emulsion polymerization, preference being given to solution polymerization.

The polymerization is preferably carried out in water as a solvent. However, it may also be undertaken in alcoholic solvents, especially $C_1$-$C_4$ alcohols such as methanol, ethanol and isopropanol, or mixtures of these solvents with water.

Suitable polymerization initiators are compounds which decompose both thermally and photochemically (photoinitiators) to form free radicals. Among the thermally activable polymerization initiators, preference is given to initiators with a decomposition temperature in the range from 20 to 180° C., in particular from 50 to 90° C. Examples of suitable thermal initiators are inorganic peroxo compounds and azo compounds. These initiators may be used in combination with reducing compounds as initiator/regulator systems.

If desired, it is also possible to use polymerization regulators. Suitable regulators are the compounds known to those skilled in the art, for example sulfur compounds such as mercaptoethanol, 2-ethylhexyl thioglycolate, thioglycolic acid and dodecyl mercaptan. When polymerization regulators are used, their use amount is generally from 0.1 to 15% by weight, preferably from 0.1 to 5% by weight and more preferably from 0.1 to 2.5% by weight, based on monomers a1), a2) and a3).

The polymerization temperature is generally from 30 to 200° C., preferably from 50 to 150° C. and more preferably from 80 to 120° C.

The polymerization can be carried out under atmospheric pressure, but is preferably undertaken in a closed system under the autogenous pressure which develops.

In the preparation of the copolymers a) used in accordance with the invention, monomers a1), a2) and a3) may be used as such, but it is also possible to use reaction mixtures which are obtained in the preparation of the monomers a3). For example, instead of methoxypolyethylene glycol methacrylate, it is possible to use the monomer mixture obtained in the esterification of polyethylene glycol monomethyl ether with an excess of methacrylic acid. Advantageously, the esterification can also be carried out in situ in the polymerization mixture by adding (1) acrylic acid, (2) a mixture of methacrylic acid and polyethylene glycol monomethyl ether and (3) free-radical initiator in parallel. If appropriate, a catalyst needed for the esterification, such as methanesulfonic acid or p-toluenesulfonic acid, may be used additionally.

The copolymers a) used in accordance with the invention may also be prepared by polymer-like reactions, for example by reacting an acrylic/methacrylic copolymer with polyalkylene glycol monoalkyl ether. However, preference is given to the free-radical copolymerization of the monomers.

As component b), the inventive detergent formulations comprise one or more complexing agents which are selected from the group consisting of, glycine-N,N-diacetic acid derivatives, glutamic acid N,N-diacetic acid and their salts. Preferred complexing agents b) are methylglycinediacetic acid and glutamic acid diacetic acid; particularly preferred complexing agents b) are methylglycinediacetic acid or salts thereof.

Preferred glycine-N,N-diacetic acid derivatives are those described in EP-A 0 845 456. Suitable glycine-N,N-diacetic acid derivatives are accordingly compounds of the general formula (II)

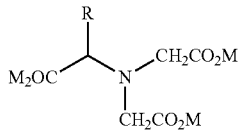

(II)

in which

R is $C_1$- to $C_{12}$-alkyl and

M is alkali metal, preferably sodium or potassium, more preferably sodium.

R is a $C_{1-12}$-alkyl radical, preferably a $C_{1-6}$-alkyl radical, more preferably a methyl or ethyl radical. As component (b) particular preference is given to using an alkali metal salt of methylglycinediacetic acid (MGDA). Very particular preference is given to using the trisodium salt of methylglycinediacetic acid.

The preparation of such glycine-N,N-diacetic acid derivatives is known and described, for example, in EP-A-0 845 456 and literature cited therein.

As component c), the inventive detergent formulations comprise low-foaming or nonfoaming nonionic surfactants. These are generally present in proportions of from 1 to 15% by weight, preferably from 1 to 10% by weight.

Suitable nonionic surfactants include the surfactants of the general formula (III)

$$R^1—(OCH_2CHR^2)_p(OCH_2CHR^3)_m—OR^4 \quad (III)$$

where $R^1$ is a linear or branched alkyl radical having from 6 to 24 carbon atoms, $R^2$ and $R^3$ are each independently hydrogen or a linear or branched alkyl radical having 1-16 carbon atoms, where $R^2 \neq R^3$ and $R^4$ is a linear or branched alkyl radical having 1 to 8 carbon atoms, p and m are each independently from 0 to 300. Preferably, p=1-50 and m=0-30.

The surfactants of the formula (II) may be either random copolymers or block copolymers having one or more blocks.

In addition, it is possible to use di- and multiblock copolymers composed of ethylene oxide and propylene oxide, which are commercially available, for example, under the name Pluronic® (BASF Aktiengesellschaft) or Tetronic® (BASF Corporation). In addition, it is possible to use reaction products of sorbitan esters with ethylene oxide and/or propylene oxide. Likewise suitable are amine oxides or alkylglycosides. An overview of suitable nonionic surfactants is given by EP-A 851 023 and by DE-A 198 19 187.

The formulations may further comprise anionic, cationic, amphoteric or zwitterionic surfactants, preferably in a blend with nonionic surfactants. Suitable anionic and zwitterionic surfactants are likewise specified in EP-A 851 023 and DE-A 198 19 187. Suitable cationic surfactants are, for example, $C_8$-$C_{16}$-dialkyldimethylammonium halides, dialkoxydimethylammonium halides or imidazolinium salts with a long-chain alkyl radical. Suitable amphoteric surfactants are, for example, derivatives of secondary or tertiary amines such as $C_6$-$C_{18}$-alkyl betaines or $C_6$-$C_{15}$-alkyl sulfobetaines, or amine oxides such as alkyldimethylamine oxides.

As component d), the inventive detergent formulations may comprise bleaches and, if appropriate, bleach activators.

Bleaches subdivide into oxygen bleaches and chlorine bleaches. Oxygen bleaches which find use are alkali metal perborates and hydrates thereof, and also alkali metal percarbonates. Preferred bleaches in this context are sodium perborate in the form of a mono- or tetrahydrate, sodium percarbonate or the hydrates of sodium percarbonate.

Oxygen bleaches which can likewise be used are persulfates and hydrogen peroxide.

Typical oxygen bleaches are also organic peracids, for example perbenzoic acid, peroxy-alpha-naphthoic acid, peroxylauric acid, peroxystearic acid, phthalimidoperoxy-caproic acid, 1,12-diperoxydodecanedioic acid, 1,9-diperoxyazelaic acid, diperoxo-isophthalic acid or 2-decyldiperoxybutane-1,4-dioic acid.

In addition, the following oxygen bleaches may also find use in the detergent formulation:

Cationic peroxy acids which are described in the patent applications U.S. Pat. Nos. 5,422,028, 5,294,362 and 5,292,447;

sulfonylperoxy acids which are described in the patent application U.S. Pat. No. 5,039,447.

Oxygen bleaches are used in amounts of generally from 0.5 to 30% by weight, preferably of from 1 to 20% by weight, more preferably of from 3 to 15% by weight, based on the overall detergent formulation.

Chlorine bleaches and the combination of chlorine bleaches with peroxidic bleaches may likewise be used. Known chlorine bleaches are, for example, 1,3-dichloro-5,5-dimethylhydantoin, N-chlorosulfamide, chloramine T, dichloramine T, chloramine B, N,N'-dichlorobenzoylurea, N,N'-dichloro-p-toluenesulfonamide or trichloroethylamine. Preferred chlorine bleaches are sodium hypochlorite, calcium hypochlorite, potassium hypochlorite, magnesium hypochlorite, potassium dichloroisocyanurate or sodium dichloroisocyanurate.

Chlorine bleaches are used in amounts of generally from 0.1 to 20% by weight, preferably of from 0.2 to 10% by weight, more preferably of from 0.3 to 8% by weight, based on the overall detergent formulation.

In addition, small amounts of bleach stabilizers, for example phosphonates, borates, metaborates, metasilicates or magnesium salts, may be added.

Bleach activators are compounds which, under perhydrolysis conditions, give rise to aliphatic peroxocarboxylic acids having preferably from 1 to 10 carbon atoms, in particular from 2 to 4 carbon atoms, and/or substituted perbenzoic acid. Suitable compounds comprise one or more N- or O-acyl groups and/or optionally substituted benzoyl groups, for example substances from the class of the anhydrides, esters, imides, acylated imidazoles or oximes. Examples are tetraacetylethylenediamine (TAED), tetraacetylmethylenediamine (TAMD), tetraacetylglycoluril (TAGU), tetra-acetylhexylenediamine (TAHD), N-acylimides, for example N-nonanoylsuccinimide (NOSI), acylated phenolsulfonates, for example n-nonanoyl- or isononanoyloxy-benzenesulfonates (n- and iso-NOBS), pentaacetylglucose (PAG), 1,5-diacetyl-2,2-dioxohexahydro-1,3,5-triazine (DADHT) or isatoic anhydride (ISA).

Likewise suitable as bleach activators are nitrile quats, for example, N-methylmorpholinium-acetonitrile salts (MMA salts) or trimethylammonium-acetonitrile salts (TMAQ salts).

Preferred bleach activators are from the group consisting of polyacylated alkylenediamines, more preferably TAED, N-acylimides, more preferably NOSI, acylated phenolsulfonates, more preferably n- or iso-NOBS, MMA and TMAQ.

In addition, the following substances may find use as bleach activators in the detergent formulation:

carboxylic acids, for example phthalic anhydride; acylated polyhydric alcohols, for example triacetin, ethylene glycol diacetate or 2,5-diacetoxy-2,5-dihydrofuran; the enol esters known from DE-A 196 16 693 and DE-A 196 16 767, and also acylated sorbitol and mannitol and/or the mixtures thereof described in EP-A 525 239; acylated sugar derivatives, in particular pentaacetylglucose (PAG), pentaacetylfructose, tetraacetyl-xylose and octaacetyllactose, and also acylated, optionally N-alkylated, glucamine and gluconolactone, and/or N-acylated lactams, for example N-benzoylcaprolactam, which are known from the documents WO 94/27970, WO 94/28102, WO 94/28103, WO 95/00626, WO 95/14759 and WO 95/17498.

The hydrophilically substituted acylacetals listed in DE-A 196 16 769 and the acyllactams described in DE-A 196 16 770 and WO 95/14 075 may be used, just like the combinations, known from DE-A 44 43 177, of conventional bleach activators.

Bleach activators are used in amounts of generally from 0.1 to 10% by weight, preferably of from 1 to 9% by weight, more preferably of from 1.5 to 8% by weight, based on the overall detergent formulation.

As component e), the inventive detergent formulations may comprise further builders. It is possible to use water-soluble and water-insoluble builders, whose main task consists in binding calcium and magnesium.

The further builders used may be:

low molecular weight carboxylic acids and salts thereof, such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate, α-hydroxypropionic acid;

oxidized starches, oxidized polysaccharides;

homo- and copolymeric polycarboxylic acids and salts thereof, such as polyacrylic acid, polymethacrylic acid, copolymers of maleic acid and acrylic acid;

graft polymers of monoethylenically unsaturated mono- and/or dicarboxylic acids on monosaccharides, oligosaccharides, polysaccharides, aminopolycarboxylates and polyaspartic acid;

phosphonates such as 2-phosphono-1,2,4-butanetricarboxylic acid, aminotri-(methylenephosphonic acid), 1-hydroxyethylene(1,1-diphosphonic acid), ethylene-diaminetetramethylenephosphonic acid, hexamethylenediaminetetramethylene-phosphonic acid or diethylenetriaminepentamethylenephosphonic acid;

silicates such as sodium disilicate and sodium metasilicate;

water-insoluble builders such as zeolites and crystalline sheet silicates.

As component f), the inventive detergent formulations comprise one or more enzymes. It is possible to add to the detergent between 0 and 8% by weight of enzymes based on the overall formulation in order to increase the performance of the detergent or to ensure the cleaning performance in the same quality under milder conditions. The enzymes used most frequently include lipases, amylases, cellulases and proteases. In addition, it is also possible, for example, to use esterases, pectinases, lactases and peroxidases.

The inventive detergents may additionally comprise, as component g), further additives such as anionic or zwitterionic surfactants, bleach catalysts, alkali carriers, corrosion inhibitors, defoamers, dyes, fragrances, fillers, organic solvents and water.

In addition to or instead of the above-listed conventional bleach activators it is also possible for the sulfonimines known from EP-A 446 982 and EP-A 453 003 and/or bleach-boosting transition metal salts or transition metal complexes to be present in the inventive detergent formulations as what are known as bleach catalysts.

The useful transition metal compounds include, for example, the manganese-, iron-, cobalt-, ruthenium- or molybdenum-salen complexes known from DE-A 195 29 905 and the N-analog compounds thereof known from DE-A 196 20 267, the manganese-, iron-, cobalt-, ruthenium- or molybdenum-carbonyl complexes known from DE-A 195 36 082, the manganese, iron, cobalt, ruthenium, molybdenum, titanium, vanadium and copper complexes which have nitrogen-containing tripod ligands and are described in DE-A 196 05 688, the cobalt-, iron-, copper- and ruthenium-amine complexes known from DE-A 196 20 411, the manganese, copper and cobalt complexes described in DE-A 44 16 438, the cobalt complexes described in EP-A 272 030, the manganese complexes known from EP-A 693 550, the manganese, iron, cobalt and copper complexes known from EP-A 392 592, and/or the manganese complexes described in EP-A 443 651, EP-A 458 397, EP-A 458 398, EP-A 549 271, EP-A 549 272, EP-A 544 490 and EP-A 544 519. Combinations of bleach activators and transition metal bleach catalysts are known, for example, from DE-A 196 13 103 and WO 95/27775.

Dinuclear manganese complexes which comprise 1,4,7-trimethyl-1,4,7-triazacyclo-nonane (TMTACN), for example $[(TMTACN)_2Mn^{IV}Mn^{IV}(\mu\text{-}O)_3]^{2+}(PF_6^-)_2$ are likewise suitable as effective bleach catalysts. These manganese complexes are likewise described in the aforementioned documents.

Preferred bleach catalysts are bleach-boosting transition metal complexes or salts from the group consisting of the manganese salts and complexes and the cobalt salts and complexes. More preferred are the cobalt(amine) complexes, the cobalt(acetate) complexes, the cobalt(carbonyl) complexes, the chlorides of cobalt or manganese, manganese sulfate or $[(TMTACN)_2Mn^{IV}Mn^{IV}(\mu\text{-}O)_3]^{2+}(PF_6^-)_2$.

Bleach catalysts may be used in amounts of from 0.0001 to 5% by weight, preferably of from 0.0025 to 1% by weight, more preferably of from 0.01 to 0.25% by weight, based on the overall detergent formulation.

As further constituents of the detergent formulation, alkali carriers may be present. Alkali carriers are ammonium and/or alkali metal hydroxides, ammonium and/or alkali metal carbonates, ammonium and/or alkali metal hydrogencarbonates, ammonium and/or alkali metal sesquicarbonates, ammonium and/or alkali metal silicates, ammonium and/or alkali metal disilicates, ammonium and/or alkali metal metasilicates and mixtures of the aforementioned substances, preference being given to using ammonium and/or alkali metal carbonates and ammonium and/or alkali metal disilicates, in particular sodium carbonate, sodium hydrogencarbonate or sodium sesquicarbonate and β- and δ-sodium disilicates $Na_2Si_2O_5.yH_2O$.

The corrosion inhibitors used may be silver protectants from the group of the triazoles, the benzotriazoles, the bis-benzotriazoles, the aminotriazoles, the alkylaminotriazoles and the transition metal salts or complexes. Particular preference is given to using benzotriazole and/or alkylaminotriazole. In addition, active chlorine-containing agents which distinctly reduce the corrosion of the silver surface frequently find use in detergent formulations. In chlorine-free detergents, preference is given to using oxygen- and nitrogen-containing organic redox-active compounds such as di- and trihydric phenols, for example hydroquinone, pyrocatechol, hydroxyhydroquinone, gallic acid, phloroglucine, pyrogallol and derivatives of these compound classes. Salt- and complex-type inorganic compounds such as salts of the metals Mn, Ti, Zr, Hf, V, Co and Ce frequently also find use. Preference is given in this context to the transition metal salts which are selected from the group of the manganese and/or cobalt salts and/or complexes, more preferably from the group of the cobalt(amine) complexes, the cobalt(acetate) complexes, the cobalt(carbonyl) complexes, the chlorides of cobalt or manganese, and of magnesium sulfate. It is likewise possible to use zinc compounds or bismuth compounds to prevent corrosion on the ware, especially glass.

Paraffin oils and silicone oils may optionally be used as defoamers and to protect plastics and metal surfaces. Defoamers are used generally in proportions of from 0.001% by weight to 5% by weight. In addition, dyes, for example patent blue, preservatives, for example Kathon CG, perfumes and other fragrances may be added to the inventive detergent formulation.

An example of a suitable filler is sodium sulfate.

The present invention also provides mixed powders or mixed granules for use in detergent formulations for machine dishwashing, composed of a) from 10 to 95% by weight of the copolymers as defined above composed of components a1), a2) and, if appropriate, a3) and a4), b) from 5 to 80% by weight of complexing agents selected from the group consisting of glycine-N,N-diacetic acid derivatives and glutamic acid N,N-diacetic acid, and salts thereof, and, if appropriate, c) from 0 to 20% by weight of a polyethylene glycol, of a nonionic surfactant or of a mixture thereof.

As component c), it is possible to use a polyethylene glycol, more preferably having a mean molecular weight (weight-average molecular weight) of from 500 to 30 000 g/mol.

The polyethylene glycol used as component c) has preferably OH end groups and/or $C_{1-6}$-alkyl end groups. In the inventive mixture, particular preference is given to using, as component c), a polyethylene glycol which has OH and/or methyl end groups.

The polyethylene glycol preferably has a molecular weight (weight-average molecular weight) of from 1000 to 5000 g/mol, most preferably from 1200 to 2000 g/mol.

Suitable compounds usable as component c) are nonionic surfactants. These are preferably selected from the group consisting of alkoxylated, primary alcohols, alkoxylated fatty alcohols, alkylglycosides, alkoxylated fatty acid alkyl esters, amine oxides and polyhydroxy fatty acid amides.

The nonionic surfactants used are preferably alkoxylated, advantageously ethoxylated, especially primary alcohols having preferably from 8 to 18 carbon atoms and an average of from 1 to 12 mol of ethylene oxide (EO) per mole of alcohol, in which the alcohol radical may be linear or preferably 2-methyl-branched, or may comprise linear and branched radicals in a mixture, as are typically present in oxo alcohol radicals. However, preference is given in particular to alcohol ethoxylates with linear radicals from alcohols of native origin with from 12 to 18 carbon atoms, for example from coconut alcohol, palm alcohol, tallow fat alcohol or oleyl alcohol, and an average of from 2 to 8 EO per mole of alcohol. The preferred ethoxylated alcohols include, for example, $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-14}$ alcohol with 7 EO. The degrees of ethoxylation specified are statistical averages which may be a whole or fractional number for a specific product. Preferred alcohol ethoxylates have a narrowed homologous distribution ("narrow range ethoxylates", NRE).

The inventive mixed powders or mixed granules are prepared by mixing components a), b) and c) as a powder, heating the mixture and adjusting the powder properties in the subsequent cooling and shaping process.

It is also possible to granulate components a) and b) with the already molten component c) and subsequently to cool them. The subsequent solidification and shaping are effected in accordance with the known processes of melt finishing, for example by prilling or on cooling belts with, if required, downstream steps for adjusting the powder properties, such as grinding and sieving.

The inventive mixed powders or mixed granules may also be prepared by dissolving components a), b) and c) in a solvent and spray-drying the resulting mixture, which can be followed by a granulating step. In this case, components a) to c) may be dissolved separately, in which case the solutions are subsequently mixed, or a powder mixture of the components can be dissolved in water. The solvents used may be all of those which can dissolve components a), b) and c), preference is given to using, for example, alcohols and/or water, more preferably water.

The invention is illustrated in detail by the examples which follow.

EXAMPLES

Examples 1 to 6 and Comparative Examples C1 to C9

In a reactor with nitrogen supply, reflux condenser and metering unit, a mixture of 619 g of distilled water and 2.2 g of phosphorous acid was heated to an internal temperature of 100° C. with supply of nitrogen and stirring. Then, in parallel, (1) a mixture of 123.3 g of acrylic acid and 368.6 g of distilled water, (2) a mixture of 18.4 g of sodium peroxodisulfate and 164.6 g of distilled water, (3) a mixture of 72.0 g of water, 49.1 g of methacrylic acid and 166.9 g of methoxypolyethylene glycol methacrylate ($M_w$=1100) and (4) 46 g of 40% by weight aqueous sodium hydrogensulfite solution were added continuously within 5 h. After stirring at 100° C. for a further 2 hours, the reaction mixture was cooled to room temperature and adjusted to a pH of 7.2 by adding 190 g of 50% by weight sodium hydroxide solution.

A slightly yellowish colored clear solution of a copolymer having a solids content of 25.7% by weight and a K value of 27.2 (1% by weight aqueous solution, 25° C.) was obtained.

To test the inventive combinations of copolymers and complexing agents, the following formulations were used (table 1):

TABLE 1

| Ingredients: | Formulation 1 [% by wt.] | 2 [% by wt.] | 3 [% by wt.] | 4 [% by wt.] | 5 [% by wt.] | 6 [% by wt.] |
|---|---|---|---|---|---|---|
| Methylglycinediacetic acid, Na salt | 22.2 | | 13 | 12.4 | | |
| Glutamic acid N,N-diacetic acid, Na salt | | 22.2 | | | | |
| Ethylenediaminetetraacetic acid, Na salt | | | | | 13 | 22.2 |
| Sodium citrate•2 $H_2O$ | 11.1 | 11.1 | 26 | 24.7 | 26 | 11.1 |
| Sodium carbonate | 35.6 | 35.6 | 7.8 | 7.4 | 7.8 | 35.6 |
| Sodium hydrogencarbonate | | | 24 | 22.9 | 24 | |
| Sodium disilicate ($xNa_2O$•$ySiO_2$; x/y = 2.65; 80%) | 5.6 | 5.6 | 5.2 | 4.9 | 5.2 | 5.6 |
| Sodium percarbonate ($Na_2CO_3$•1.5 $H_2O_2$) | 11.1 | 11.1 | 10.4 | 9.9 | 10.4 | 11.1 |
| Tetraacetylenediamine (TAED) | 3.3 | 3.3 | 3.1 | 3 | 3.1 | 3.3 |
| Low-foam nonionic surfactant based on fatty alcohol alkoxylates | 5.6 | 5.6 | 5.2 | 4.9 | 5.2 | 5.6 |
| Copolymer | 5.6 | 5.6 | 5.3 | 9.9 | 5.3 | 5.6 |

The testing was effected under the test conditions below:

Dishwasher: Miele G 686 SC

Wash cycles: 2 wash cycles, 55° C. Normal (without prewash)

Ware: Knives (WMF Berlin table knives, monobloc) and glass tumblers (Matador, Ruhr Kristall), plastic plates (SAN plates Kayser); ballast dishware: 6 black dessert plates Rinse temperature: 65° C.

Water hardness: 14° GH (corresponding to 250 mg $CaCO_3$/kg) or 25° GH (corresponding to 445 mg $CaCO_3$/kg)

In some of the experiments, in each case 50 g of IKW ballast soil, according to SÖFW-Journal, 124, 14/98, p. 1029, were introduced into the dishwasher at the start of the experiment.

Table 2 lists the test conditions of examples 1 to 6 and of comparative examples C1 to C9:

TABLE 2

| Example | Formulation | Water hardness [° GH] | Soil | Polymer |
|---|---|---|---|---|
| 1 | 1 | 25 | none | Copolymer from DE 102 25 594 |
| C1 | 1 | 25 | none | none |
| C2 | 6 | 25 | none | Copolymer from DE 102 25 594 |
| 2 | 2 | 25 | none | Copolymer from DE 102 25 594 |
| C3 | 2 | 25 | none | none |
| 3 | 1 | 25 | included | Copolymer from DE 102 25 594 |
| C4 | 1 | 25 | included | none |
| C5 | 6 | 25 | included | Copolymer from DE 102 25 594 |
| 4 | 1 | 14 | none | Copolymer from DE 102 25 594 |
| C6 | 1 | 14 | none | none |
| 5 | 3 | 25 | none | Copolymer from DE 102 25 594 |
| C7 | 3 | 25 | none | Polyacrylic acid sodium salt (Mw 8000) |
| C8 | 5 | 25 | none | Copolymer from DE 102 25 594 |
| 6 | 4 | 25 | none | Copolymer from DE 102 25 594 |
| C9 | 4 | 25 | none | Polyacrylic acid sodium salt (Mw 8000) |

The ware was assessed 18 h after the cleaning by visual grading in a light box which had a black coating, halogen spotlight and perforated plate, using a scale from 10 (very good) to 1 (very poor). The highest mark of 10 corresponds to film- and drip-free surfaces; from marks <3, films and drops are discernible even under normal room lighting and are thus regarded as objectionable.

The results of the wash experiments are compiled in table 3 below.

TABLE 3

| Example | Assessment (mark) Knives | Glasses | Plastic |
|---|---|---|---|
| 1 | 5.3 | 4.5 | 1.7 |
| C1 | 1 | 1.25 | 1.7 |
| C2 | 1.1 | 4.0 | 1.7 |
| 2 | 4.3 | 4.2 | 1.7 |
| C3 | 1 | 1 | 1.7 |
| 3 | 5.5 | 4.4 | 1.7 |
| C4 | 2.2 | 1.5 | 3.3 |
| C5 | 1.8 | 3.2 | 1.7 |
| 4 | 6 | 5.8 | 1.7 |
| C6 | 1 | 3.4 | 4.2 |
| 5 | 7.5 | 7 | 1.7 |
| C7 | 5 | 5 | 1.7 |
| C8 | 6.9 | 3.2 | 3.3 |
| 6 | 4.5 | 6.9 | 1.7 |
| C9 | 5.1 | 3.7 | 1.7 |

The experiments show that the use of inventive copolymers in combination with selected complexing agents can distinctly reduce film formation, especially on glass and stainless steel.

What is claimed is:

1. A mixed powder or mixed granule, consisting of:

a) from 10 to 95% by weight of a copolymer of a1) from 50 to 93 mol % of acrylic acid and/or of a water-soluble salt of acrylic acid, a2) from 5 to 30 mol % of methacrylic acid and/or of a water-soluble salt of methacrylic acid, and a3) from 2 to 20 mol % of at least one nonionic monomer of the formula (I)

(I)

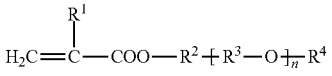

in which the variables are each defined as follows:

$R^1$ is hydrogen or methyl, $R^2$ is a chemical bond or unbranched or branched $C_1$-$C_6$-alkylene, $R^3$ are identical or different, unbranched or branched $C_2$-$C_4$-alkylene radicals, $R^4$ is unbranched or branched $C_1$-$C_6$-alkyl, n is from 3 to 50, wherein monomers a1) to a3) are copolymerized in a random or block manner, b) from 5 to 80% by weight of a complexing agent selected from the group consisting of a glycine-N,N-diacetic acid derivative and glutamic acid N,N-diacetic acid and salts thereof, c) from 0 to 20% by weight of a polyethylene glycol, of a nonionic surfactant or of a mixture thereof;

wherein said mixed powder or mixed granule is suitable for use in a detergent formulation for machine dishwashing.

2. The mixed powder or mixed granule according to claim 1, which is suitable for use in a phosphate-free detergent formulation for machine dishwashing.

3. The mixed powder or mixed granule according to claim 1, wherein the complexing agent b) is methylglycinediacetic acid and/or salts thereof.

4. The mixed powder or mixed granule according to claim 1, wherein the compound of formula (I) is methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth) acrylate, ethoxypolyethylene glycol (meth)acrylate, ethoxypolypropylene glycol (meth)acrylate, ethoxypolybutylene glycol (meth)acrylate and ethoxypoly(propylene oxide-co-ethylene oxide) (meth)acrylate.

5. The mixed powder or mixed granule according to claim 1, wherein the compound of formula (I) is methoxypolyethylene glycol methacrylate.

6. The mixed powder or mixed granule according to claim 1, wherein the copolymer has a mean molecular weight $M_w$ of from 3 000 to 50 000.

7. The mixed powder or mixed granule according to claim 1, wherein a K value of the copolymer is from 15 to 40 as measured in 1% by weight aqueous solution at 25° C., according to H. Fikentscher, Cellulose-Chemie, vol. 13, p. 58-64 and 71-74 (1932)).

8. The mixed powder or mixed granule according to claim 1, wherein the component b) is methylglycinediacetic acid or a salt thereof.

9. The mixed powder or mixed granule according to claim 1, wherein the component b) is a glycine-N,N-diacetic acid derivative of the general formula (II)

(II)

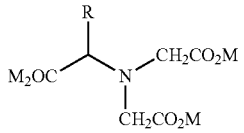

wherein

R is $C_1$- to $C_{12}$-alkyl, and

M is an alkali metal.

10. The mixed powder or mixed granule according to claim 1, wherein the component (b) is a trisodium salt of methylglycinediacetic acid.

11. The mixed powder or mixed granule according to claim 1, wherein the component c) has the general formula (III)

$$R^1—(OCH_2CHR^2)_p(OCH_2CHR^3)_m—OR^4 \quad (III)$$

wherein $R^1$ is a linear or branched alkyl radical having from 6 to 24 carbon atoms, $R^2$ and $R^3$ are each independently hydrogen or a linear or branched alkyl radical having 1-16 carbon atoms, with the proviso that $R^2 \neq R^3$, $R^4$ is a linear or branched alkyl radical having 1 to 8 carbon atoms, p=1-50, and m=0-30.

* * * * *